US008997405B2

(12) United States Patent
Geyer

(10) Patent No.: US 8,997,405 B2
(45) Date of Patent: Apr. 7, 2015

(54) STANCHION FOR A WELL CARCASS OF AN ELEVATOR INSTALLATION

(75) Inventor: Thomas Geyer, Hünstetten (DE)

(73) Assignee: Thoma Aufzuge GmbH, Frankfurt (DE)

( * ) Notice: Subject to any disclaimer, the term of this patent is extended or adjusted under 35 U.S.C. 154(b) by 0 days.

(21) Appl. No.: 13/131,966

(22) PCT Filed: Dec. 17, 2009

(86) PCT No.: PCT/EP2009/009074

§ 371 (c)(1),
(2), (4) Date: May 31, 2011

(87) PCT Pub. No.: WO2010/069572

PCT Pub. Date: Jun. 24, 2010

(65) Prior Publication Data

US 2011/0232226 A1 Sep. 29, 2011

(30) Foreign Application Priority Data

Dec. 18, 2008 (DE) ..... 10 2008 063 529
Oct. 9, 2009 (DE) ..... 10 2009 048 989

(51) Int. Cl.

| | |
|---|---|
| ***B66B 11/00*** | (2006.01) |
| ***B66B 7/02*** | (2006.01) |
| ***E04C 3/30*** | (2006.01) |
| ***E04F 17/00*** | (2006.01) |

(52) U.S. Cl.

CPC . *B66B 7/023* (2013.01); *E04C 3/30* (2013.01); *B66B 11/0005* (2013.01); *E04F 17/005* (2013.01)

(58) Field of Classification Search

CPC ..... E04B 2002/7487; E04B 2002/749; E04B 2002/7488; E04B 2/7425; E04B 2/7854; E04B 2/7433; E04B 2/76; B66B 11/00; B66B 11/005; B66B 7/023; E04F 17/005; E04C 3/30

USPC ..... 52/30, 238.1, 239, 241, 651.05, 120, 52/121, 850, 301, 834, 843; 187/414

See application file for complete search history.

(56) References Cited

U.S. PATENT DOCUMENTS 2,164,428 A * 7/1939 Rhodes ..... 52/295
2,191,681 A * 2/1940 Rawson ..... 52/651.05

(Continued)

FOREIGN PATENT DOCUMENTS

DE 1174470 7/1964
DE 33 08 233 A1 9/1984

(Continued)

*Primary Examiner* — Andrew J Triggs

(74) *Attorney, Agent, or Firm* — Antonelli, Terry, Stout & Kraus, LLP.

(57) ABSTRACT

The invention relates to a post (129) for a shaft scaffold (102) of an elevator system (103), said post comprising at least two supports (236) on its exterior sides which extend approximately parallel to the longitudinal axis of the shaft scaffold (102), to which at least one traverse strut (201) can be connected. The aim of the invention is to produce and design the device, the post and/or the associated connecting elements of the post for a shaft scaffold of an elevator system in such a cost-effective manner that an easy and rapid assembly of a shaft scaffold can be ensured. According to the invention, said aim is achieved by providing, apart from the two supports (236), at least one additional support (236) for the connection of at least one guide element (220).

17 Claims, 11 Drawing Sheets

(56) References Cited

U.S. PATENT DOCUMENTS

| | | | | |
|---|---|---|---|---|
| 2,381,647 | A * | 8/1945 | Cibulka | 52/651.05 |
| 4,986,330 | A * | 1/1991 | McGonagle | 160/135 |
| 5,044,473 | A * | 9/1991 | Gripe | 187/244 |
| 5,590,504 | A * | 1/1997 | Heard et al. | 52/836 |
| 5,816,000 | A * | 10/1998 | Izatt et al. | 52/238.1 |
| 6,035,974 | A | 3/2000 | Richter et al. | |
| 6,250,032 | B1 * | 6/2001 | Davis et al. | 52/239 |
| 6,296,419 | B1 * | 10/2001 | Millet et al. | 403/408.1 |
| 6,339,907 | B1 * | 1/2002 | Dame et al. | 52/239 |
| 6,341,457 | B1 * | 1/2002 | Aerts et al. | 52/239 |
| 6,478,172 | B2 * | 11/2002 | Zingerman | 212/179 |
| 6,493,995 | B2 * | 12/2002 | McKenzie | 52/36.4 |
| 6,523,320 | B2 * | 2/2003 | Stoof | 52/651.05 |
| 6,679,013 | B2 | 1/2004 | Hornung | |
| 6,679,016 | B2 * | 1/2004 | Liu | 52/238.1 |
| 7,578,109 | B2 * | 8/2009 | Reynolds et al. | 52/648.1 |
| 8,281,546 | B2 * | 10/2012 | Thompson | 52/745.17 |
| 2006/0231350 | A1 | 10/2006 | Hashiguchi | |
| 2006/0260878 | A1 | 11/2006 | Hashiguchi | |
| 2009/0038255 | A1 * | 2/2009 | Knauf | 52/717.06 |
| 2011/0232226 | A1 * | 9/2011 | Geyer | 52/831 |

FOREIGN PATENT DOCUMENTS

| | | |
|---|---|---|
| DE | 89 01 978 U1 | 8/1989 |
| DE | 94 06 399 U1 | 7/1994 |
| EP | 1 741 660 | 1/2007 |
| EP | 1 935 826 | 6/2008 |
| EP | 2358625 | 8/2011 |
| JP | 04-049179 | 2/1992 |
| JP | 06-127868 | 5/1994 |
| JP | 2003-002556 | 1/2003 |
| JP | 2005-314013 | 11/2005 |
| WO | WO 2008/110241 | 9/2008 |

* cited by examiner

STANCHION FOR A WELL CARCASS OF AN ELEVATOR INSTALLATION

The invention relates to a stanchion for a well carcass of an elevator installation, which stanchion has at least two receptacles on its outer sides which extend approximately parallel to the longitudinal axis of the well carcass, to which receptacles at least one cross strut can be connected.

It is already generally known to provide elevator installations, in particular platform elevators for the disabled or elevators for goods transport, which are equipped with a preassembled well carcass.

Said well carcass can be mounted as a loadbearing or self-supporting well carcass in the inner region or in the outer region. The loadbearing well carcass construction consists of stanchions and cross transoms in the form of carcass profiles, in particular steel hollow profiles. In order that a protection means can be produced which is closed at least over the displacement path, well carcasses are frequently lined with glass, facing tiles or another material. In addition to the static function and to receiving the carcass lining, the well carcass also serves to guide the load suspension means. The load suspension means can be moved over a predefined path, what is known as the conveying height. The load suspension means can be an elevator cabin or else only an elevator platform.

The guide rails which are fastened in the region between the load suspension means and the inner boundary of the well, in the concrete case to the well carcass, belong to the essential components of the guide of the load suspension means. At least one guide rail, but two in the normal case, is/are required to guide the load suspension means. Steel rails in the form of T profiles are used as guide rails.

The invention is based on the object of producing and configuring the stanchions and/or the associated connecting elements of the stanchion for a well carcass of an elevator installation inexpensively in such a way that easy, quick mounting of a well carcass is possible.

According to the invention, the object is achieved by virtue of the fact that, in addition to the two receptacles, at least one further receptacle is provided for connecting at least one guide element. As a result, a stanchion is provided in a simple and inexpensive way for a well carcass, which can be mounted without problems and very rapidly in a free-standing manner on site or in an elevator well.

The advantageously configured stanchions, together with the corresponding cross transoms which match them, make a well lining possible which is arranged linearly on all sides.

According to another feature of the invention, in order to fasten the well lining, cross struts or cross transoms can also advantageously be used to fasten the well lining. As a result, lining elements, such as glass panes, can be readily installed in a simple way into a well carcass in conjunction with the advantageously configured seals.

The cross section or the outline of the well carcass is advantageously configured to be square. However, the outline can also be configured to be oval, round or polygonal, the refinement according to the invention of the stanchion making it possible to readily connect in each case the stanchions which are arranged opposite one another to one another diagonally via the crossmember and the drive shaft which extends transversely with respect thereto. If, for example, the well carcass has four stanchions, the drive shaft of the load suspension means and the crossmember can be arranged at right angles to one another.

To this end, it is advantageous that the further receptacle for connecting at least the one guide element is provided between the two receptacles or the central receptacle which is provided on the stanchion is configured as a guide groove, and that one or more grooves which are configured as receptacles projects/project to the outside on a wall of the stanchion or is/are placed on the wall or integrally formed with the wall and/or is/are provided within the profile of hollow configuration of the stanchion. As a result, weight can be saved and the well carcass can be produced less expensively.

According to one development of the invention, a further possibility is that the guide element is let at least into the central groove which is connected to the walls of the stanchion and is provided between the two grooves which are configured as receptacles, which guide element interacts with a guide which is provided on the elevation installation and/or on a carrying frame or side element of the load suspension means, in particular travel platform.

Furthermore, it is advantageous that the cross section of the profile of the stanchion is configured to be round, oval, polygonal, in particular rectangular, and the two receptacles which serve to connect a cross strut and/or to connect well linings of the well carcass are provided on the wall or the two sides, in particular the sides of the stanchion which converge at right angles.

It is also advantageous that all the grooves are open to one side and the central groove which is provided between the two grooves lying on the outside serves to receive the guide rail which is accessible from outside. As a result, the mounting of the well carcass is likewise facilitated.

It is advantageous that the guide rail is connected integrally to or forms one structural unit with the stanchion.

It is of particular significance for the present invention that sliding blocks and/or clamping pieces which can be fixed with the aid of fastening elements, in particular threaded bolts, and serve to connect the cross struts or transoms are inserted into one or more grooves.

It is also advantageous that at least one further receptacle, in particular groove, is provided on the stanchion and/or the cross strut or the transom for connecting wall parts of the well carcass and/or clamping parts and/or sealing elements, which further receptacle is arranged on the side wall of the stanchion and/or the cross strut or the transom and serves to receive clamping parts and/or wall parts of the well carcass.

Furthermore, it is advantageous that a further receptacle, in particular groove, is formed with the aid of two side elements which extend in parallel, stand upright on the wall of the stanchion and/or on the wall of the cross strut or the transom, into which receptacle at least one clamping part is inserted, and that, in addition to the further receptacle, in particular groove, an additional receptacle for connecting the wall part and/or at least one sealing element, in particular dry seal, of the well carcass and/or for connecting a connection piece for the cross strut or the transom are/is provided.

It is also advantageous that the additional receptacle on the stanchion and/or on the cross strut or the transom is formed by a side element of the further receptacle and an upright wall part which is arranged on the stanchion and/or on the cross strut or the transom.

Furthermore, it is advantageous that, at its one end, the connection piece for connecting the cross strut or the transom has a projection which is inserted into the additional receptacle with an accurate fit and is fastened to the stanchion with the aid of the clamping piece, in particular sliding block, and/or threaded bolts.

According to one development of the invention, an additional possibility is characterized by the following features:

a) the stanchion has at least two walls which are arranged at an approximate right angle, b) the walls extend parallel to a longitudinal center axis of the stanchion and/or of the well carcass, c) in each case one receptacle which serves to connect the cross struts and/or to connect the well linings of the well carcass is provided on the two walls which extend at an angle between 450° and 145° or at an approximate right angle, d) a third receptacle, for connecting the guide, or the guide is oriented centrally and is provided between the two outer receptacles, e) a longitudinal center axis of the central receptacle is oriented in such a way that a further stanchion can be placed diagonally opposite in the well carcass, the receptacles which lie opposite one another serving to indirectly or directly connect a drive shaft and/or a crossmember.

Furthermore, it is advantageous that the stanchions of the well carcass are connected to one another with the aid of the cross struts or transoms, and the stanchion is made from an extruded aluminum hollow profile.

Furthermore, it is advantageous that the guide rail is composed of steel, is inserted into the first or central groove during the extrusion operation and forms a structurally fixed unit with the stanchion.

It is also advantageous that the guide rail is adhesively bonded into the first groove and at least the two outer grooves have an approximately identical cross section.

The well carcass according to the invention comprises, inter alia, two, in particular four, stanchions and the cross pieces or transoms. They are configured and connected to one another in such a way that the drive shaft for driving the elevator installation crosses the crossmember for receiving the drive motor at right angles in an upper region or an upper section, so that this also results in a very stable, torsionally rigid well carcass, into which the vertically movable elevator platform is integrated which can be used, in particular, for people but also for loads.

The stanchions and carcass stanchions and transoms for the well carcass according to the invention are advantageously formed from extruded aluminum hollow profiles. However, it is also possible to produce stanchions and carcass stanchions and transoms from solid profiles. Extruded hollow profiles are advantageously used; the well carcass can thus be produced less expensively. The extrusion process makes it possible to select different, even complicated shapes for the stanchions and to adjust very rapidly to individual customers' wishes. The profile according to the invention of the stanchion is particularly suitable for this purpose. The desired number of grooves which make the connection of guide elements or guide rails, cross pieces or transoms and well linings possible can be machined readily into the stanchion.

As a result of the advantageously designed profiles of the stanchions, the weight of the stanchions can be reduced greatly and, moreover, the stability and torsional rigidity of the well carcass can be increased substantially, since no reworking of the profile of the stanchion, for example if a stress concentrator and therefore weakening of the stanchion occurs, is required after the extrusion.

The corrosion resistance is also improved substantially by the advantageous material selection of the components.

The guide rails and stanchions can be manufactured in various standard lengths and can therefore be used for well carcasses of different heights. They can be composed of machined flat bar steel or of unalloyed structural steel of lengths between 3 and 13 m, and can be configured with a nominal width of approximately 100 mm and a nominal thickness of approximately 10 mm.

A stanchion for a well carcass of an elevator installation is advantageous, which stanchion has at least two receptacles on its outer sides which extend approximately parallel to the longitudinal axis of the well carcass, to which receptacles the at least one cross strut can be connected; at least one guide element is provided on the stanchion, which guide element is received in a receptacle which is provided on the stanchion and is assigned at least one further receptacle.

In a further refinement of the invention, it is advantageous that at least the two outer grooves have an approximately identical cross section, as a result of which the stanchions can be used versatilely.

Further advantages and details of the invention are explained in the patent claims and in the description and are shown in the figures; in which:

Figure 1:
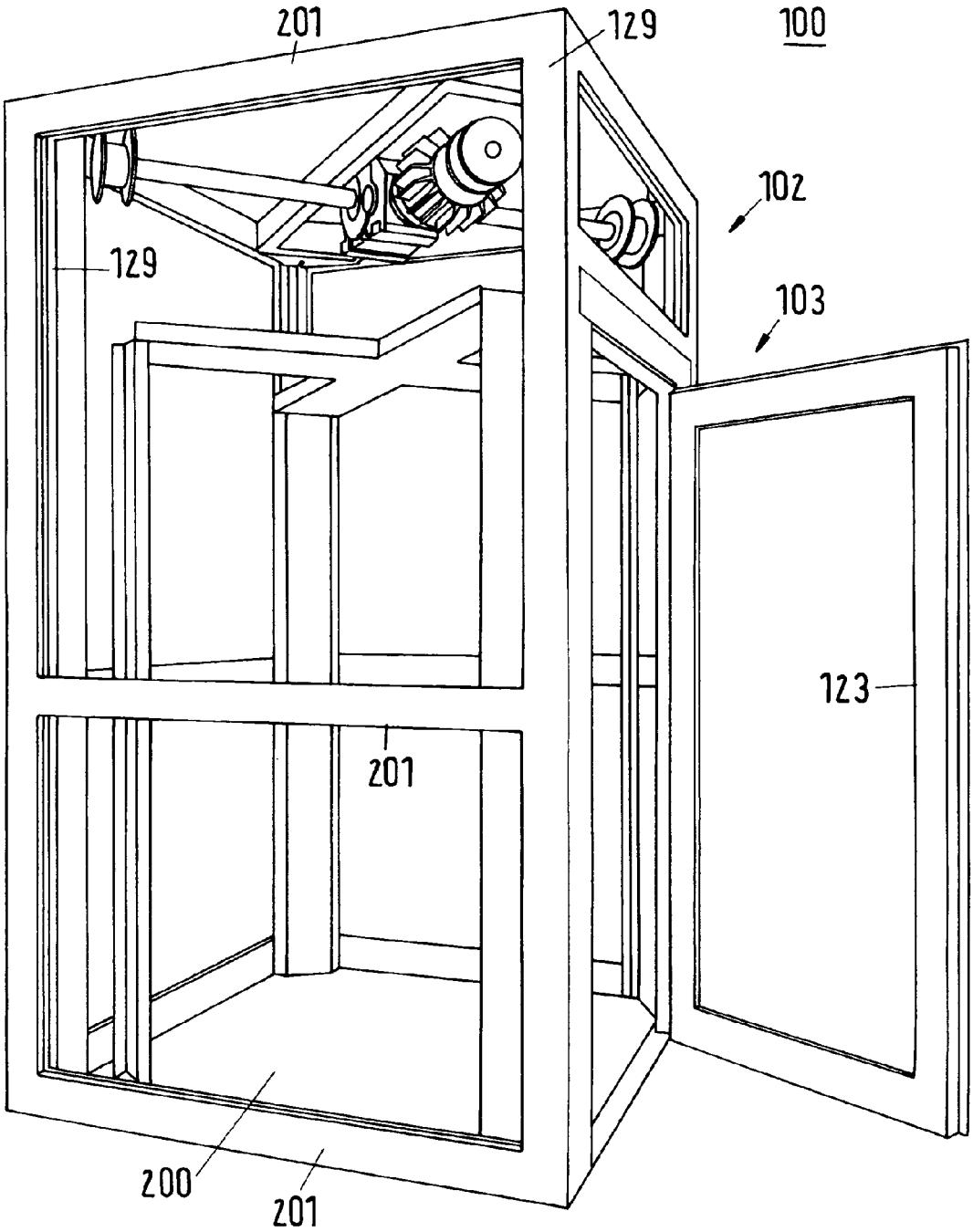
FIG. 1 shows a perspective part view of the upper part of the well carcass for an elevator installation, which well carcass can be arranged so as to stand free and/or in an elevator well.
Figure 2:
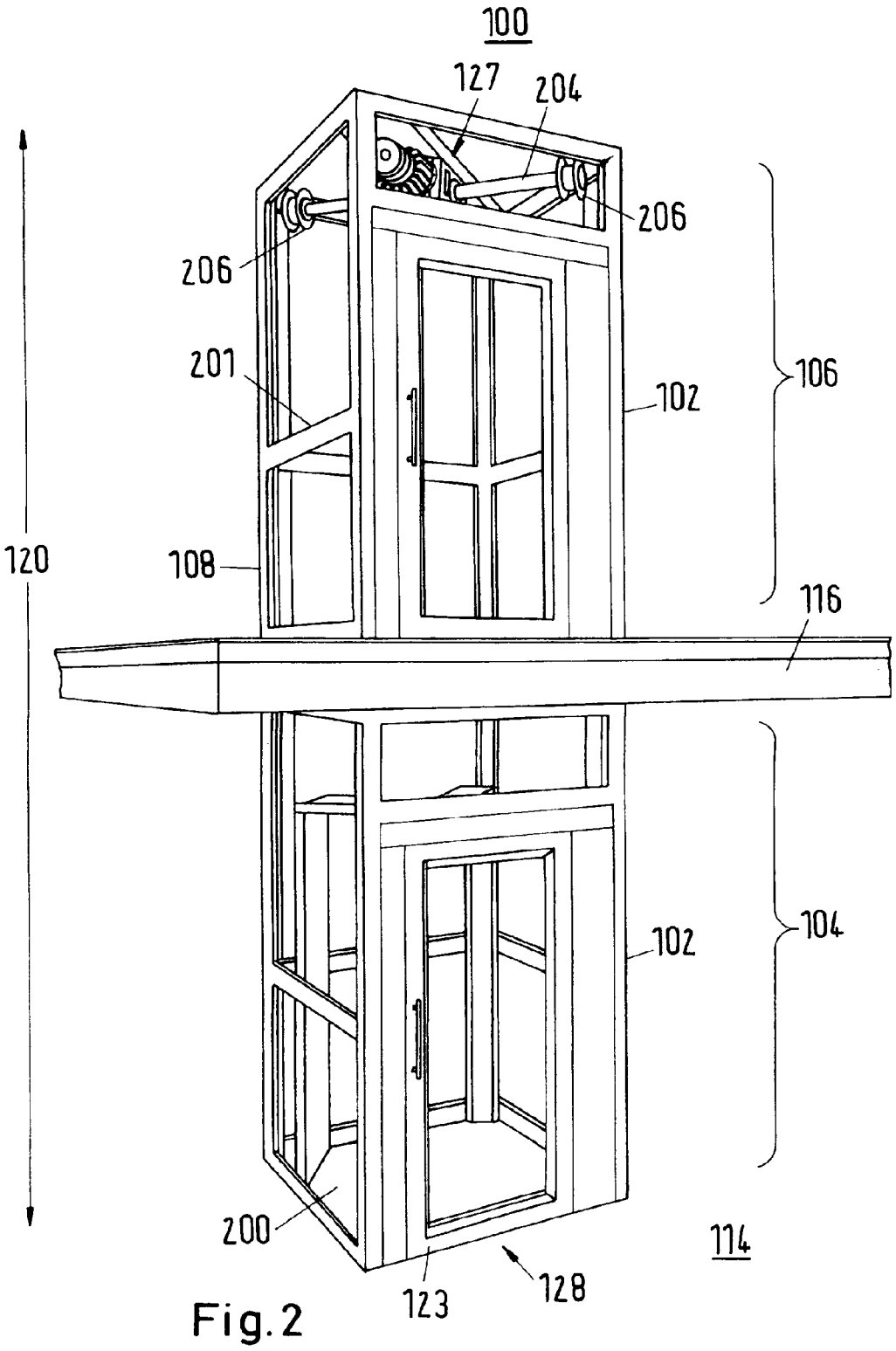
FIG. 2 shows a diagrammatic perspective illustration of the well carcass.

The drawing according to FIGS. 1 and 2 shows a well carcass 102 for an elevator installation 103 which well carcass can be arranged to be free-standing or in an elevator well 100. In the elevator well 100, the well carcass 102 can be arranged to be free-standing or can be supported with the aid of connecting elements on side walls (not shown in the drawing) of the elevator well 100.

Figure 4:
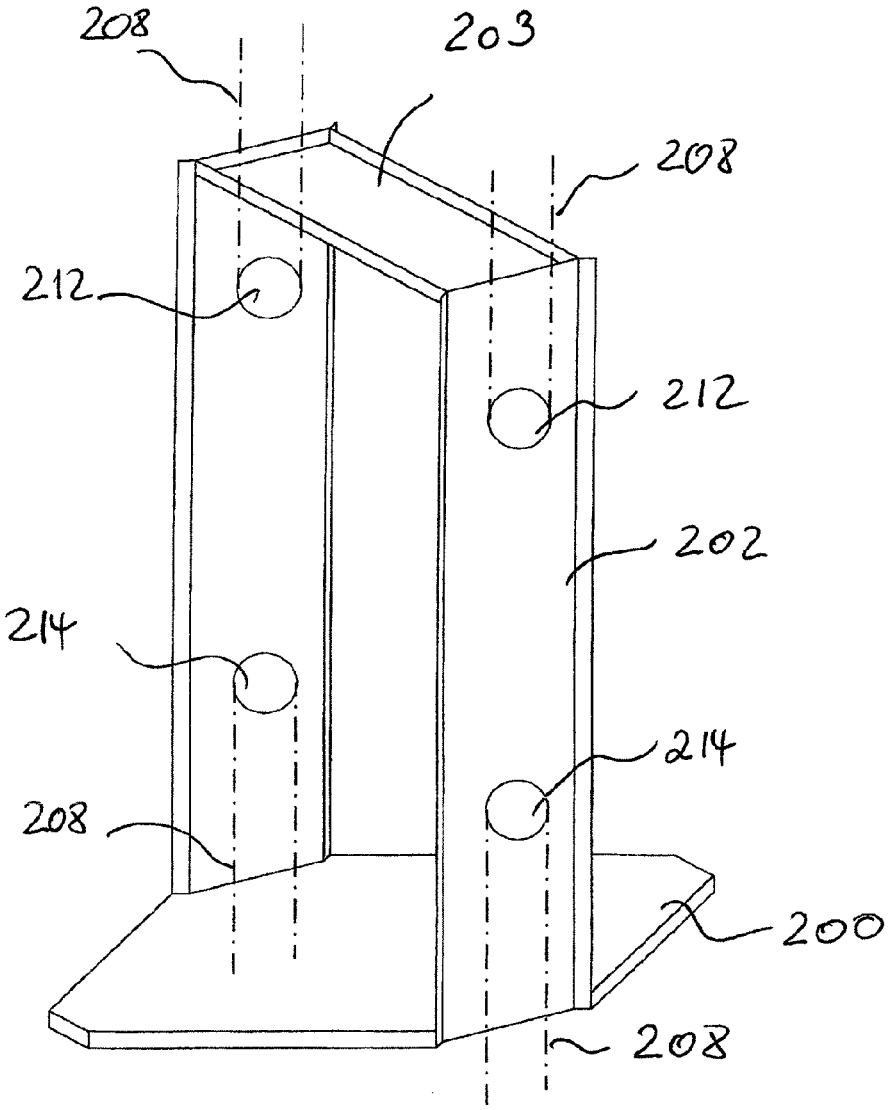
FIG. 4 shows a perspective illustration of the travel platform with side parts which are arranged so as to lie opposite one another.

According to FIG. 2, a storey ceiling 116 is supported on a lower section 104 of the well carcass 102. To this end, an opening 118 is situated in the storey ceiling 116, through which opening 118 the load suspension means, in particular a travel platform 200 (FIG. 4), is moved vertically up and down with the aid of carrying means 208 (FIG. 4). The lower section 104 of the well carcass 102 stands with the aid of mount feet in a wellpit 114.

An upper section 106 of the well carcass 102 is situated above the storey ceiling 116 and is called a wellhead 124. In this section according to the exemplary embodiment shown in FIG. 2, the drive arrangement is shown with a drive motor 126 and a gear, in particular worm gear 125. The drive motor 126 with a drive shaft 204 can be arranged in the wellhead 124 of the well carcass 102 or in the wellpit 114.

The upper section 106 of the elevator well carcass 102 is arranged on the storey ceiling 116. In this way, the well carcass 102 can be arranged from floor to floor or, in the case of a correspondingly large opening, as a continuous construction. An entire well carcass height 120 can span a plurality of floors, it also being possible for a conveying height 122 to be more than three meters.

According to FIG. 1, the load suspension means, in particular the travel platform 200, is arranged in the well carcass 102 such that it can be moved vertically. The cross section of the well carcass 102 and/or of the load suspension means, in particular the travel platform 200, is configured to be round, oval or polygonal, preferably square.

At least in the end edge region and/or in a corner region 105 of the travel platform 200, the load suspension means 200 or the travel platform which is configured to be square in the exemplary embodiment has two upright side elements 202 which lie diagonally opposite one another and are connected to the carrying means 208. The carrying means 208 can be a cable traction device or a cable traction device which operates according to the principle of a pulley block 209.

The magnitude of the force to be applied, for example in order to move the elevator load, can be reduced with the aid of the pulley block 209. The pulley block consists of fixed and/or loose deflecting pulleys or rollers and a drawing means or a cable. The toothed belt assembly follows the same principle, except that a toothed belt is used here instead of a cable. In the cable assembly or pulley block 209 used here, two stationary anchorings 216 and 218 are used according to the invention. However, the number of loadbearing cables, to which the load is distributed, is always decisive for the tensile force. In the depicted basic form of the pulley block, the tension a is identical at every point of the cable. The weight force $F_L$ of the mass is therefore distributed uniformly to all n connections between the lower and the upper rollers and the loadbearing cables. The tensile force at the end of the cable is proportional to the tension in the cable and therefore the following applies: $F_Z=F_l/n=mg/n$.

The pulley block 209 according to the invention can have a step-up ratio of 1:1, 2:1, 3:1, 4:1, 5:1 or greater. In this way, a counterweight can be dispensed with, inter alia.

The two side elements 202 which lie diagonally opposite one another are connected to one another at their upper end via an upper cross piece 203. Apart from the two side elements 202 which lie diagonally opposite one another, the load suspension means, in particular the travel platform 200, does not have any further side parts. In this way, four free access openings 128 are obtained which can also be closed with the aid of a door 123. According to another embodiment in accordance with FIG. 6, in addition to the two side elements 202, the travel platform can have additional side walls which are formed, for example, from glass, metal or from a plastic material.

The drawing means device 208 operates according to the principle of a pulley block and is therefore called a pulley block 209 in the following text. It has one or more deflecting pulleys 206, 212, 214, 219.

Figure 3:
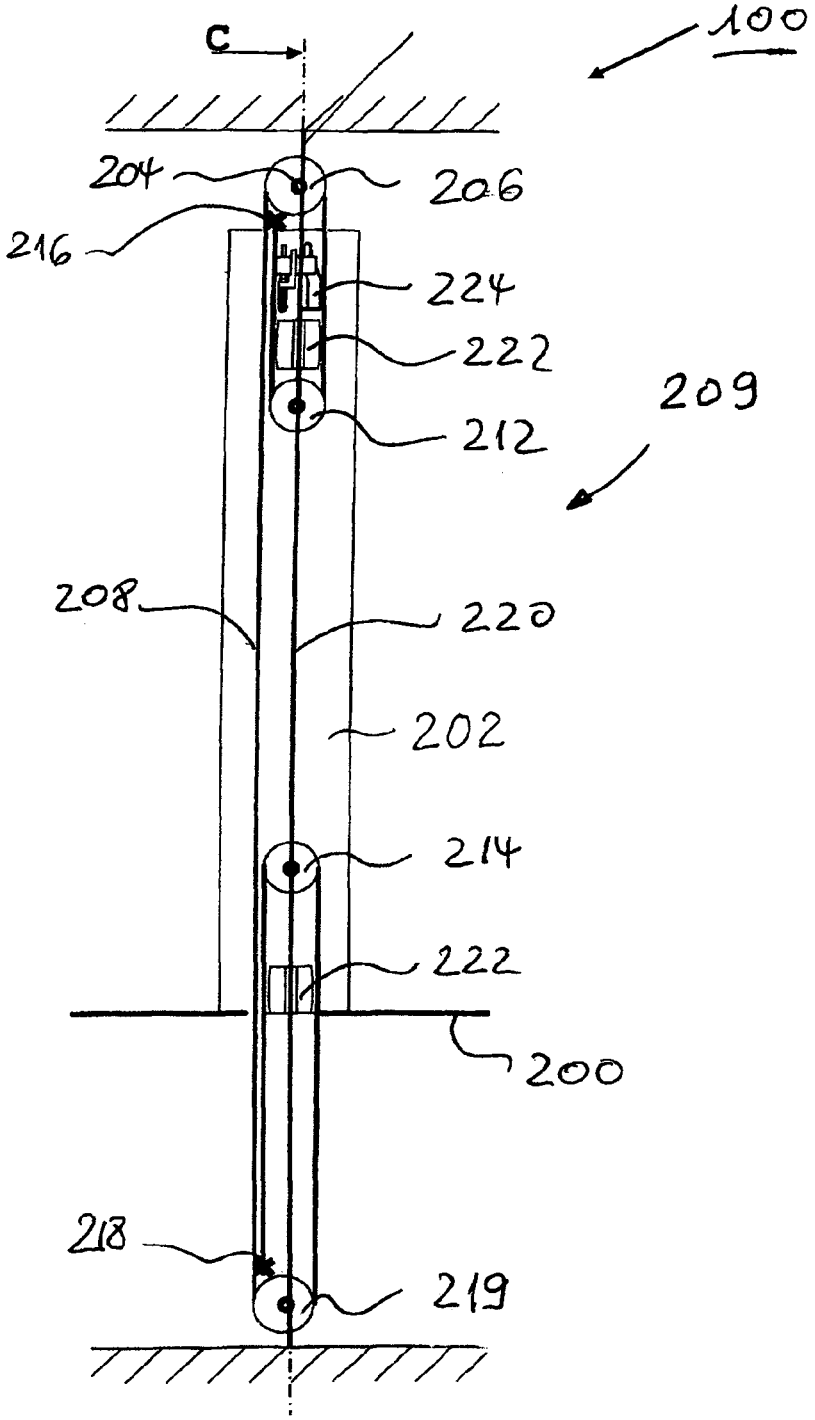
FIG. 3 shows a diagrammatic illustration of the cable traction device which can be installed into the well carcass according to FIG. 1.

The load suspension means, in particular the travel platform 200, is guided vertically in the well carcass 102 with the aid of at least one guide, in particular a guide rail 220 which is arranged on the well carcass (FIG. 3). The guide is arranged at least in the corner region 105 (FIG. 5) of the well carcass 102 and/or in the immediate vicinity of the carrying means 208, in particular the pulley block 209.

The carrying means 208 which are arranged on both sides of the travel platform 200 run from the end suspension or anchoring 216 which is provided in the wellhead 124 and is connected to the wall of the elevator well 100 or to the well carcass 102, via the deflecting pulley 212 to the drive pulley 206, and from there via the deflecting pulley 219 which is situated in the wellpit 114 or is connected fixedly to the wall of the elevator well 100 or to the well carcass 102 with the aid of the anchoring 218. From there, the carrying means 208 runs further via the deflecting pulley 214 which is arranged on the side element or carrying frame 202 to the end suspension or anchoring 218 which is either fastened to the well carcass 102 or in the wellpit 114.

To this end, the carrying frame 202 is equipped with guides 222 which extend in the vertical direction, have depressions and are guided on the guide rail 220 which is arranged on the carrying frame 202 or on the side element 202 (FIG. 3). If the carrying means 208 or the drive axle breaks, an emergency braking device 224 which is arranged fixedly on the carrying frame 202 (FIG. 3) is activated automatically.

Figure 5:
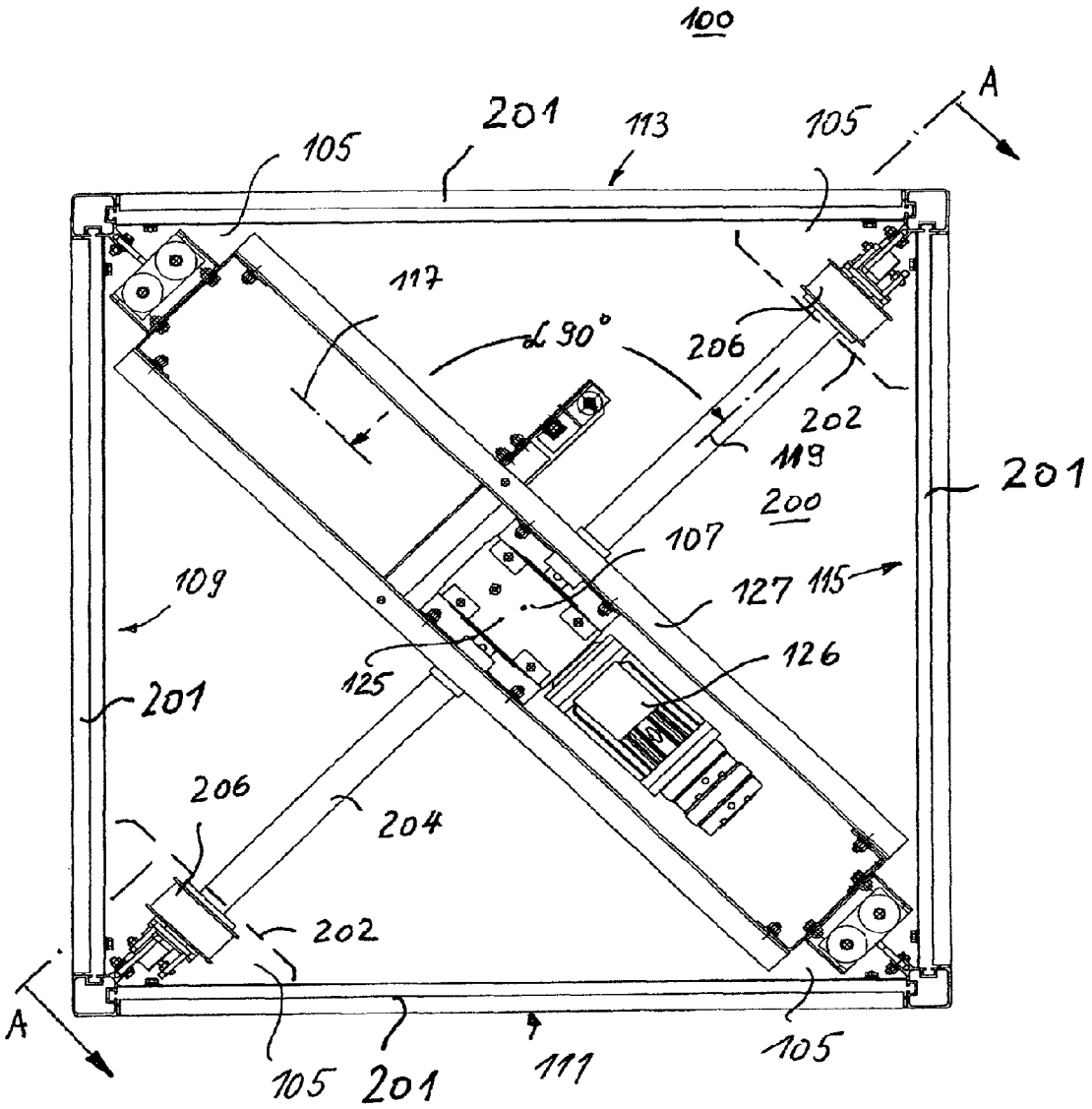
FIG. 5 shows a view of the well carcass with drive device in the view from above according to FIG. 1.

As is apparent from FIGS. 1 and 5, the drive motor 126 is arranged on a crossmember 127 which is situated in the upper wellhead 124. The crossmember 127 is arranged between the two corner regions 105 of the well carcass 102, which lie diagonally opposite one another, and is connected to said well carcass 102. However, it is also possible to connect the crossmember 127 fixedly to the corner regions 105 of the wall elements of the elevator well 100. One or else two horizontally extending drive shafts 204 is/are connected to the drive motor 126 with the aid of the worm gear 125. One or two drive shafts 204 which is/are oriented coaxially with respect to one another and is/are operatively connected to the drive motor 126 can extend between the corner regions 105 of the well carcass 102 which lie opposite one another. Furthermore, it is possible that each drive shaft is operatively connected to in each case one drive motor. The drive motor can also be arranged at any other angle with respect to the drive axle or the drive axles or at a spacing from the drive axle.

The crossmember 127 and the drive shaft 204 cross one another at right angles and therefore extend in each case into the corner regions 105 which lie opposite one another. As has already been mentioned, they are connected fixedly to the well carcass 102 or to a wall of the elevator well 100 or are mounted there. The torsional rigidity of the well carcass 102 is improved substantially by the connection of the crossmember 127 and the drive shaft 204 to the well carcass 102.

The drive motor 126 has an output shaft, the rotational axis 117 of which is arranged approximately at right angles to a rotational axis 119 of the drive shaft 204 of the carrying means, in particular drawing means device 208.

The well carcass 102 consists of four longitudinal sides 109, 111, 113 and 115 which are oriented at right angles to one another and extend vertically. Each longitudinal side 109, 111, 113 and 115 consists of a rectangular frame with stanchions or longitudinal struts 129 which can be connected fixedly to one another via a plurality of cross struts or transoms 201. The central cross strut 201 can be dispensed with depending on the embodiment, with the result that each longitudinal side 109, 111, 113 and 115 also has a free access opening 128 to the load suspension means, in particular to the travel platform.

The carrying means 208 which are assigned to the ends of the drive shafts 204 extend in the immediate vicinity of and parallel to the vertically extending longitudinal sides 109, 111, 113, 115 of the well carcass 102 which form the corner regions and/or to a longitudinal center axis 107.

Furthermore, in each case one carrying means 208 is arranged in a space saving manner in the two corner regions 105 which lie diagonally opposite one another. The carrying means 208 are provided in each case between a side element 202 of the travel platform 200 and longitudinal sides 109, 111, 113, 115 of the well carcass 102, which form the corner region 105 of approximately triangular configuration, or the walls of the elevator shaft 100.

FIGS. 6 to 15 show the stanchions 129 and the cross strut or the transom 201 for the well carcass 102 of the elevator installation 103 in detail.

The stanchion 129 has outer sides or walls 205, which extend in parallel to its longitudinal center axis 240 and to the longitudinal center axis 107 of the well carcass 102, and at least two outer receptacles 236, to which at least one cross strut 201 can be connected.

The cross section of the profile of the stanchion 129 can be configured to be round, oval, polygonal, rectangular, in particular square, and the two outer receptacles 236 which, as mentioned, serve to connect the cross strut 201 (FIGS. 6 to 9) can be provided on its two sides or walls 205 which converge at right angles.

The two walls 205 of the stanchion 129 extend at an approximate right angle or else at an angle $\alpha$ between 54° and 145°.

In addition to the two receptacles 236, at least one further receptacle 232 is provided for connecting a guide element 220. The guide element 220 is connected centrally between the two cross struts or transoms 201 to the two walls 205 which extend at an approximate right angle $\alpha$. The guide element 220 interacts with a guide 222 which is provided on the elevator installation 103 and/or on the carrying frame or side element 202 of the load suspension means, in particular travel platform 200 (FIG. 3).

Figure 12:
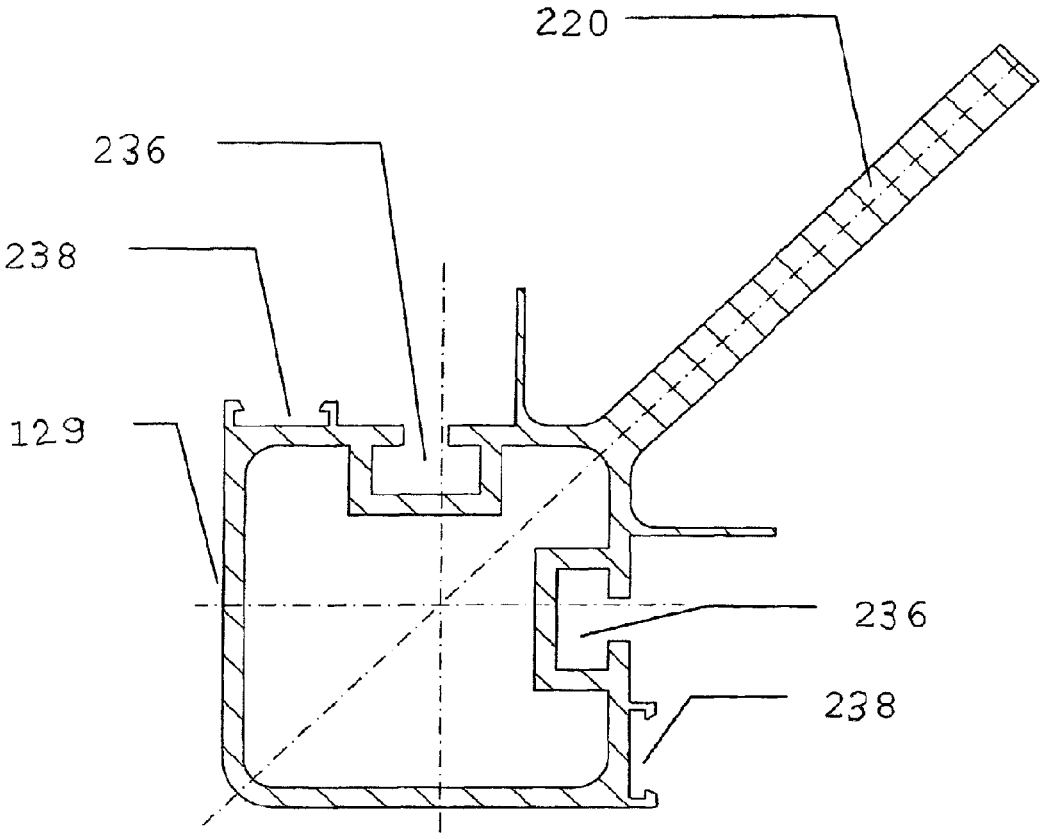
FIG. 12 shows a sectional illustration of a further exemplary embodiment of the stanchion with an integrally attached guide rail.

According to FIG. 12, the guide rail 220 can be connected integrally to or manufactured as one component with the stanchion 129. The two outer grooves 236 at least have an approximately identical cross section.

One or more grooves 232, 236, 238 configured as receptacles can project to the outside, that is to say can also be placed, on the wall 205 of the stanchion 129 and/or can be provided within the profile of hollow configuration of the stanchion 129. All the receptacles 232, 236, 238 can also be configured as a T groove.

All the grooves 232, 235, 236, 238 and 502 are open toward one side, the groove 232 which is provided between the two grooves 236 lying on the outside serving, as already mentioned, to receive the guide rail 220 which is accessible from outside.

Figure 6:
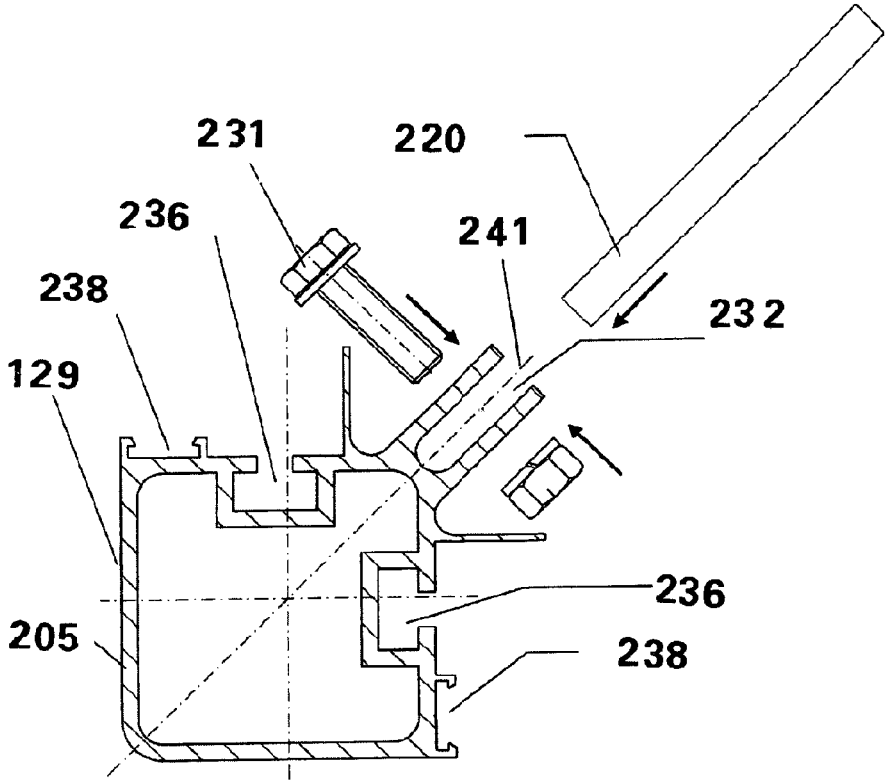
FIG. 6 to FIG. 11 show a sectional illustration of the stanchion with the associated attachment parts, and individual mounting steps for connecting the cross strut or the transom and the wall parts of the elevator installation.
Figure 7:
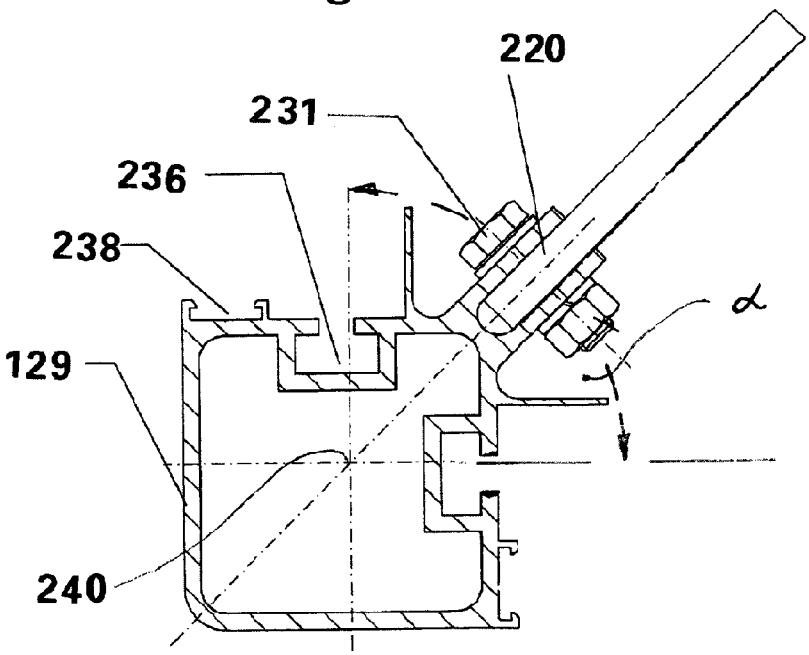
Figure 8:
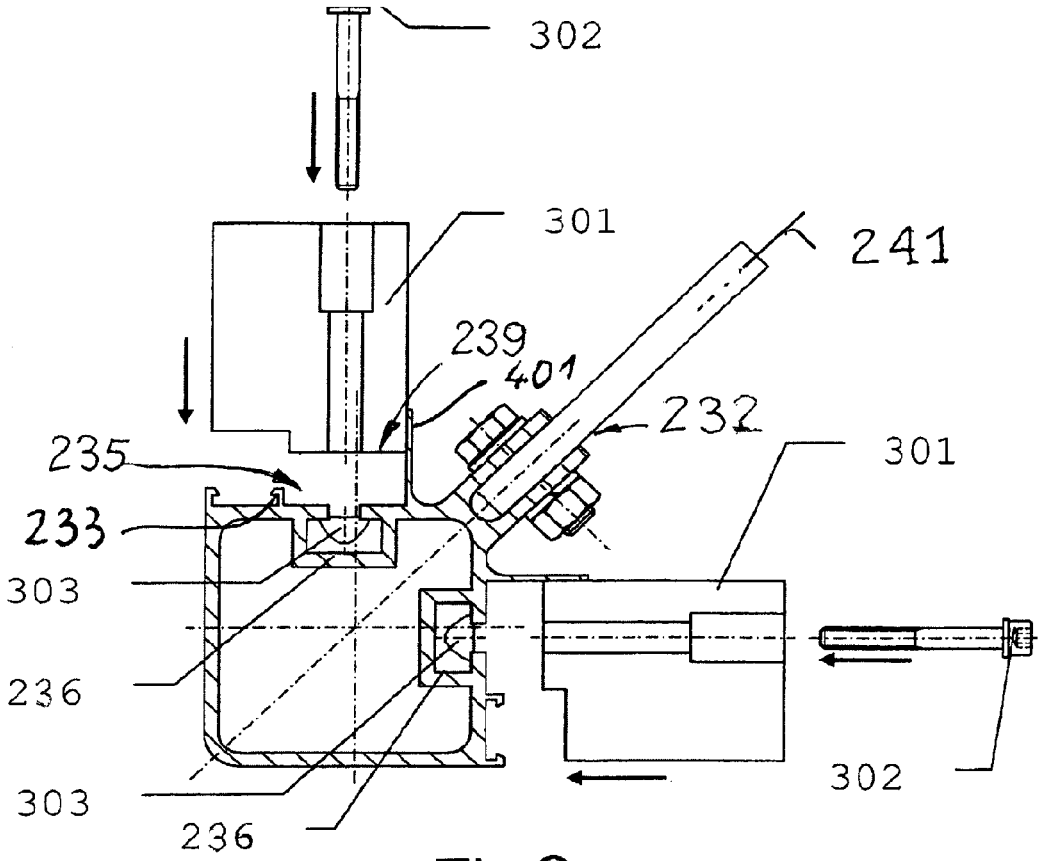
Figure 9:
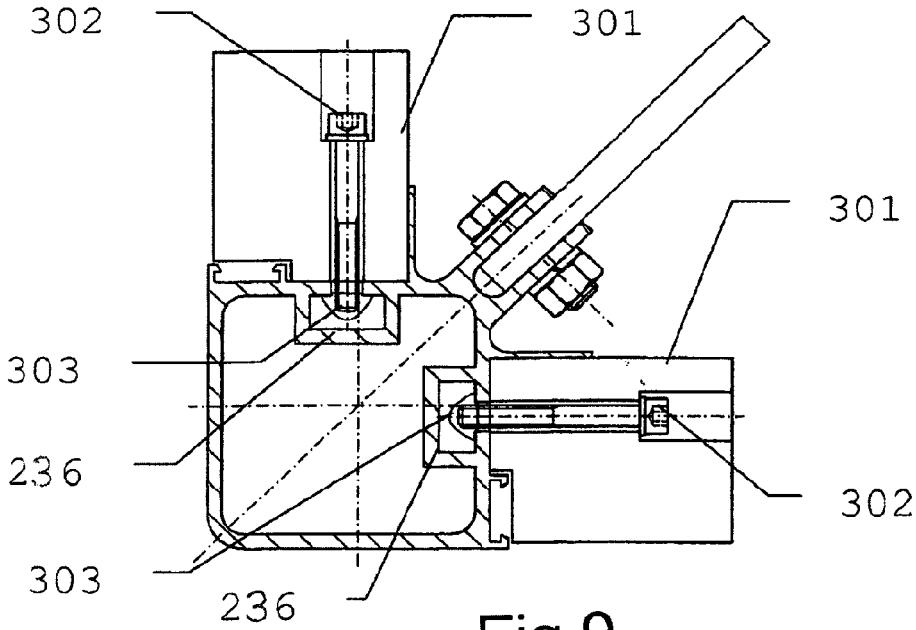
Figure 10:
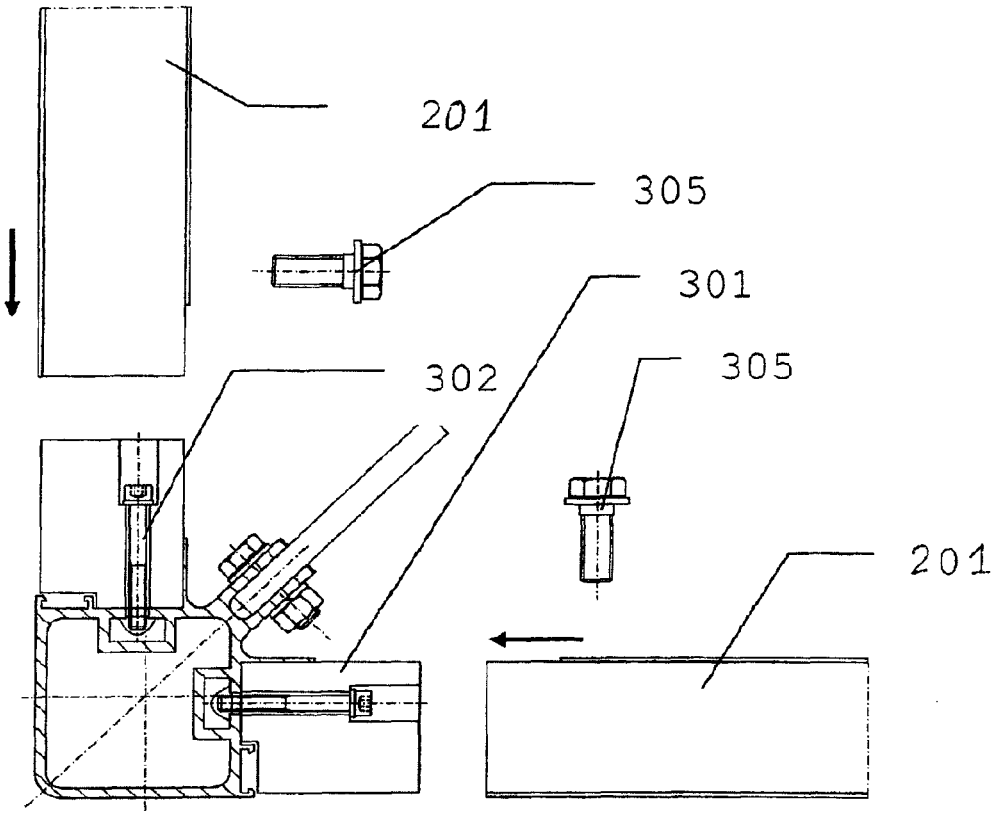
Figure 11:
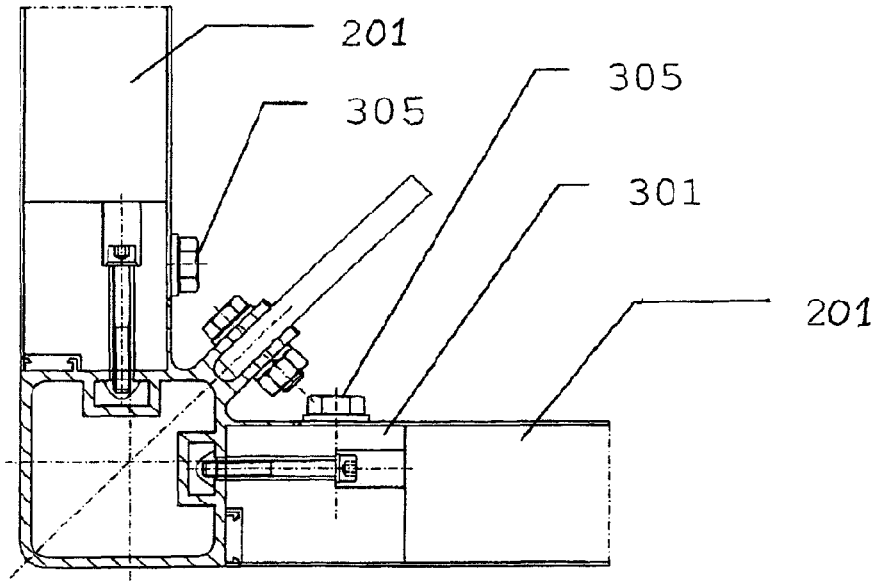

As is apparent from FIGS. 6 to 8, sliding blocks and/or clamping pieces 303 which can be fixed with the aid of fastening elements, in particular threaded bolts 302, and serve to connect the cross struts or transoms 201 are inserted into one or more grooves 235.

The further receptacles, in particular grooves 238, 502, (FIG. 8 and FIG. 13) are formed with the aid of a side element 233, which stands upright on the wall 205 of the stanchion 129 and/or on the wall of the cross strut or the transom 201, and a wall extending in parallel or a stop edge 403.

Figure 13:
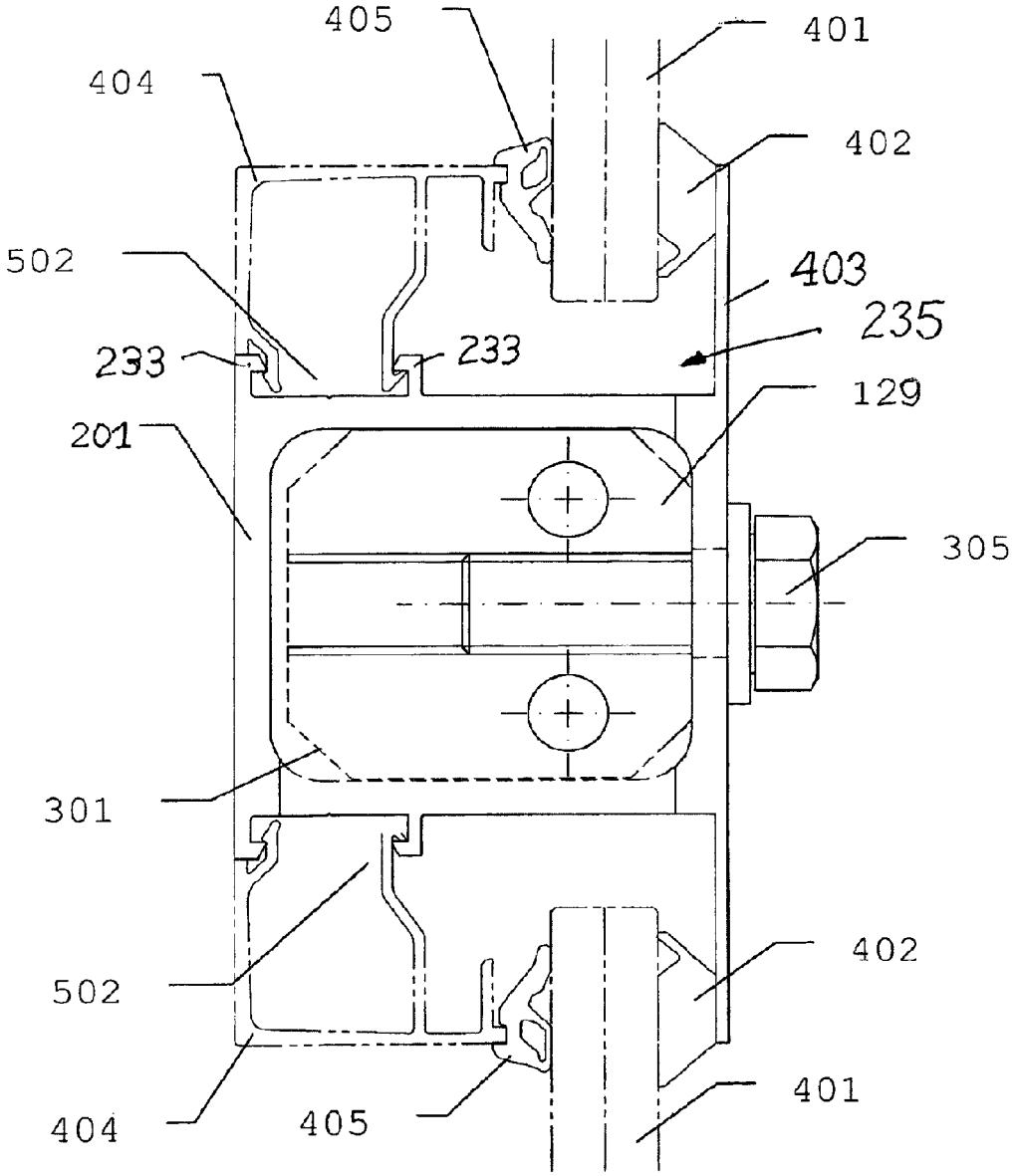
FIG. 13 shows a sectional illustration of a mounted cross piece or transom and the stanchion and a part of the wall lining for the well carcass.
Figure 14:
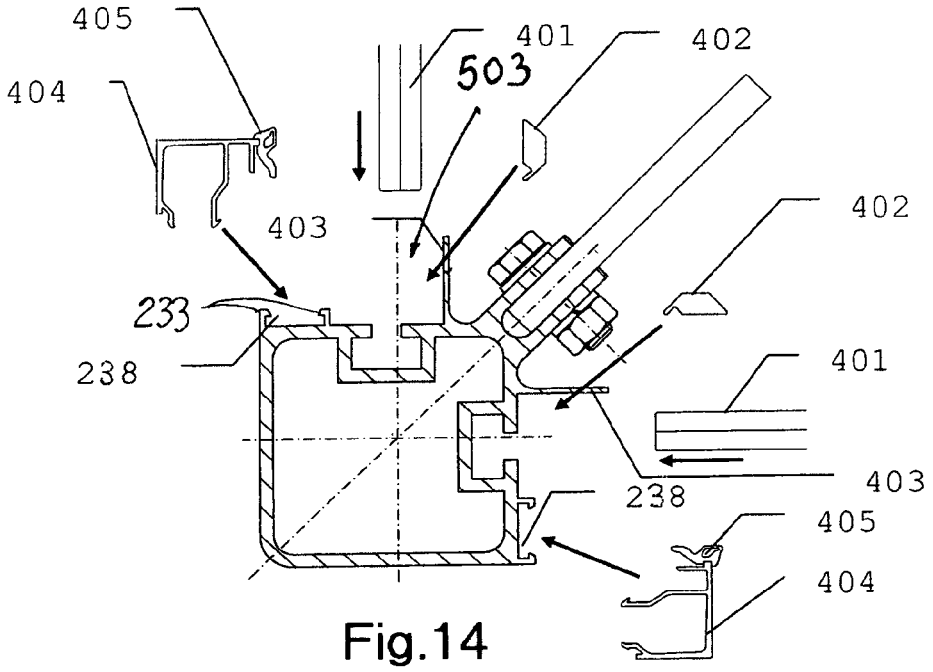
FIG. 14 and FIG. 15 show the installation phases of the walls for the well carcass 102.
Figure 15:
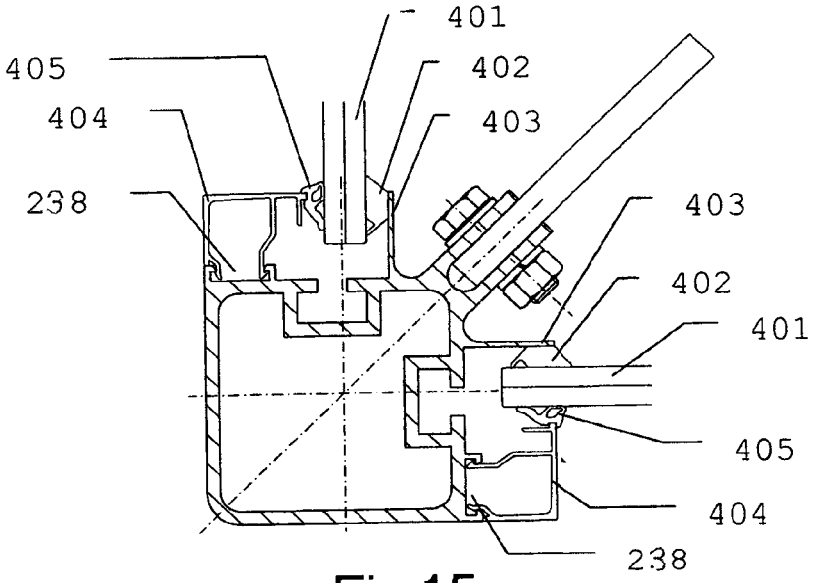

According to FIGS. 8 and 13, a connection piece 301 for connection for the cross strut or the transom 201 can be attached to the groove 236 which is provided on the stanchion 129. The connection piece 301 (FIG. 13) is fastened releasably to the groove 236 with the aid of the clamping piece or sliding block 303, which is provided in the groove 236, and a threaded bolt 302.

The connection piece 301 (FIG. 8) has, at its one end, a projection 239 for connecting the cross strut or the transom 201, which projection 239 is inserted into the additional receptacle 235 with an accurate fit and is secured with the aid of the clamping piece, in particular sliding block 303, and/or the threaded bolt 302 on the stanchion 129.

As, furthermore, is apparent from FIG. 13, the receptacles and the clamping groove 502 and the additional groove 235 are provided on the two walls 205 of the cross strut or the transom 201 which lie opposite one another. As a result, a wall part or the well lining 401 and two seals 402, 405 and a clamping part 404 can be inserted into the grooves 235 and 502 and can be clamped fixedly.

Furthermore, it is apparent from FIG. 13 that the clamping part 404 is inserted into the additional receptacle 502 and then presses against the seal 405 which is applied on the wall part 401 and bears against one side of the wall part 401, while the second seal 402 is provided between the other side of the wall part 401 and the wall part 403 and fulfills the sealing function there.

The additional receptacle 235 (FIG. 8) on the stanchion 129 and the cross strut or the transom 201 is formed by a side element 233 and an upright wall part 401.

The connection piece 301 (FIGS. 8, 10, 13) is clamped against the stanchion 129 with the aid of the threaded bolt 302 and the sliding block 303. After this, the cross strut or the transom 201 is pushed onto the connection piece 301 and fastened with the aid of a threaded bolt 305 (FIG. 13) which to this end is screwed into a threaded hole which is provided in the connection piece 301.

A further receptacle 238 (FIG. 14) is arranged on the stanchion 129 and is formed by the side elements 233. A receptacle 503 is situated next to this, which receptacle 503 consists of a side element 233 and a wall part 403 which is provided on the stanchion 129. The clamping part 404 is inserted into the receptacle 238 and the wall part 401 is inserted into the receptacle 503 sealingly with the sealing elements 402 and 405.

The stanchions 129 and the cross strut or the transom 201 can be manufactured from an extruded aluminum hollow profile. The guide rail 220 can be formed from steel. Said guide rail 220 is inserted into the groove (FIG. 6) and is fixed with the aid of a threaded bolt 231 and a nut.

According to the exemplary embodiment in accordance with FIG. 12, the guide element, in particular the guide rail 220, can form one structurally fixed unit with the stanchion (129).

A longitudinal center axis 241 (FIG. 8) of the central receptacle 232 is oriented in such a way that a further stanchion 129 can be placed diagonally opposite in the well carcass 102, the receptacles 232 which lie opposite one another serving to indirectly or directly connect the drive shaft 204 and/or the crossmember 127.

LIST OF DESIGNATIONS

100 Elevator well
102 Well carcass
103 Elevator installation
104 Lower section
105 Corner region
106 Upper section
107 Longitudinal center axis
109 Longitudinal side
111 Longitudinal side
113 Longitudinal side
114 Wellpit
115 Longitudinal side
116 Storey ceiling
117 Rotational axis of the drive motor
118 Opening
119 Rotational axis of the drive shaft
120 Well carcass height
122 Conveying height
123 Door
124 Wellhead

125 Gear, worm gear
126 Drive motor
127 Crossmember
128 Access opening
129 Stanchion, longitudinal strut
200 Load suspension means, travel platform
201 Cross strut, transom
202 Carrying frame, side element
203 Cross piece
204 Drive shaft
205 Wall, side wall of the stanchion 129
206 Deflecting pulley, drive pulley
208 Carrying means, in particular drawing means device, preferably cable traction device for a pulley block 209, in particular factor pulley block
209 Pulley block
212 Deflecting pulley
214 Deflecting pulley
216 Anchoring, upper end suspension
218 Anchoring, lower end suspension
219 Deflecting pulley
220 Guide element, guide rail on the well carcass 102
222 Guide on the travel frame, stanchion
224 Emergency braking device
231 Screw, threaded bolt
232 Receptacle, guide groove
233 Side element
235 Additional receptacle for 301, groove
236 Receptacle for transom, guide groove, outer groove
238 Further receptacle, guide groove, clamping groove
239 Projection
240 Longitudinal center axis
241 Longitudinal center axis
301 Connection piece
302 Threaded bolt
303 Clamping piece, sliding block
305 Threaded bolt
401 Wall part, well lining
402 Sealing element, dry seal
404 Clamping part
403 Wall or stop edge
405 Sealing element, dry seal
502 Groove
503 Receptacle
α Angle

The invention claimed is:

1. A stanchion configured for a well carcass of an elevator installation, comprising:

outer sides which extend approximately parallel to a longitudinal axis of the well carcass, first and second receptacles provided on respective ones of the outer sides, each of the first and second receptacles being a groove, wherein each of the first and second receptacles are configured to connect first and second structure elements comprising at least one of a cross strut and a well lining of the well carcass in positions such that the first structure element connected to the first receptacle is oriented approximately at a right angle to the second structure element connected to the second receptacle, and at least one third receptacle provided centrally between the first and second receptacles, the at least one third receptacle being configured to indirectly or directly connect at least one of a drive shaft and a crossmember in such a manner that a longitudinal axis of the drive shaft or the crossmember is oriented at an angle between the first structure element connected to the first receptacle and the second structure element connected to the second receptacle.

2. The stanchion as claimed in claim 1, wherein the third receptacle is configured as a guide groove.

3. The stanchion as claimed in claim 1, wherein the third receptacle comprises a groove that projects outward from the stanchion or is placed on the wall or is provided within the profile of hollow configuration of the stanchion.

4. The stanchion as claimed in claim 1, wherein the stanchion is manufactured from an extruded aluminum hollow profile.

5. The stanchion as claimed in claim 4, wherein the stanchion has a round or oval cross-sectional profile.

6. The stanchion as claimed in claim 4, wherein the stanchion has a polygonal cross-sectional profile.

7. The stanchion as claimed in claim 4, wherein the stanchion has a rectangular cross-sectional profile.

8. The stanchion as claimed in claim 1, wherein the third receptacle is configured to receive a guide rail.

9. The stanchion as claimed in claim 1, further comprising a guide rail connected integrally to or forming one structural unit with the stanchion.

10. The stanchion as claimed in claim 1, further comprising at least one of sliding blocks and clamping pieces, which are fixed with the aid of fastening elements and serve to connect the first and second structure elements inserted into the first and second receptacles.

11. The stanchion as claimed in claim 1, further comprising at least one fourth receptacle provided on the stanchion configured to connect at least one of connecting wall parts of the well carcass, clamping parts and sealing elements.

12. The stanchion as claimed in claim 1, further comprising a first groove formed with the aid of two side elements, each of the two side elements connected to a wall of the stanchion and extending in parallel from a point on a wall of the stanchion, the groove being configured to allow at least one clamping part to be inserted therein, and a second groove configured to connect at least one of a wall part, at least one sealing element of the well carcass, and a connection piece for the first structure element.

13. The stanchion as claimed in claim 12, wherein the second groove is formed by one of the two side elements of the first groove and an upright wall part which is arranged on the stanchion.

14. The stanchion as claimed in claim 12, further comprising a connection piece for connecting the first structure element, the connection piece having a projection which is inserted into the second groove with an accurate fit and is fastened to the stanchion with the aid of at least one of a clamping piece and threaded bolts.

15. The stanchion as claimed in claim 1, wherein the first and second receptacles are provided on two outer walls of the stanchion, the two outer walls extending parallel to a longitudinal center axis of at least one of the stanchion and the well carcass, and at an angle α between forty-five degrees and one hundred forty-five degrees to one another.

16. The stanchion as claimed in claim 1, further comprising a guide rail made from steel inserted into the third receptacle during an extrusion operation and forming a structurally fixed unit with the stanchion, wherein the first and second receptacles have an approximately identical cross section.

17. A well carcass of an elevator installation, comprising:

a plurality of stanchions arranged to define a well carcass of an elevator installation, at least a pair of the plurality of stanchions being provided diagonally opposite in the well carcass, each of the pair of the plurality of stanchions comprising:

outer sides which extend approximately parallel to a longitudinal axis of the well carcass, first and second receptacles provided on respective ones of the outer sides, each of the first and second receptacles being a groove, wherein each of the first and second receptacles are configured to connect first and second structure elements comprising at least one of a cross strut and a well lining of the well carcass in positions such that the first structure element connected to the first receptacle is oriented approximately at a right angle to the second structure element connected to the second receptacle, and at least one third receptacle provided centrally between the first and second receptacles, the third receptacle having a longitudinal center axis oriented in such a way that respective third receptacles of the pair of the plurality of stanchions provided diagonally opposite in the well carcass indirectly or directly connect at least one of a drive shaft and a crossmember, wherein a longitudinal axis of the drive shaft or the crossmember is oriented at an angle between the first structure element connected to the first receptacle and second structure element connected to the second receptacle.

* * * * *